US011213928B2

(12) United States Patent
Umemura

(10) Patent No.: US 11,213,928 B2
(45) Date of Patent: Jan. 4, 2022

(54) SHOT PROCESSING DEVICE

(71) Applicant: SINTOKOGIO, LTD., Nagoya (JP)

(72) Inventor: Mitugi Umemura, Toyokawa (JP)

(73) Assignee: Sintokogio, Ltd., Nagoya (JP)

( * ) Notice: Subject to any disclaimer, the term of this patent is extended or adjusted under 35 U.S.C. 154(b) by 542 days.

(21) Appl. No.: 16/318,182

(22) PCT Filed: Feb. 16, 2017

(86) PCT No.: PCT/JP2017/005744
§ 371 (c)(1),
(2) Date: Jan. 16, 2019

(87) PCT Pub. No.: WO2018/051529
PCT Pub. Date: Mar. 22, 2018

(65) Prior Publication Data
US 2019/0247979 A1 Aug. 15, 2019

(30) Foreign Application Priority Data
Sep. 15, 2016 (JP) ..... JP2016-180947

(51) Int. Cl.
*B24C 1/10* (2006.01)
*B24C 3/08* (2006.01)
(Continued)

(52) U.S. Cl.
CPC ..... *B24C 3/083* (2013.01); *B24C 1/10* (2013.01); *B24C 3/08* (2013.01); *B24C 3/085* (2013.01);
(Continued)

(58) Field of Classification Search
CPC .. B24C 1/10; B24C 3/08; B24C 3/081; B24C 3/083; B24C 3/085; B24C 3/10; B24C 3/14
(Continued)

(56) References Cited

U.S. PATENT DOCUMENTS 3,160,991 A * 12/1964 Bradley ..... B24C 3/14 451/89
4,394,786 A * 7/1983 Stalson ..... B08B 5/023 134/21
(Continued)

FOREIGN PATENT DOCUMENTS

CN 201586930 U 9/2010
CN 201645328 U 11/2010
(Continued)

OTHER PUBLICATIONS

International Preliminary Repost on Patentability (IPRP) dated Mar. 28, 2019 that issued in WO Patent Application No. PCT/JP2017/005744.

*Primary Examiner* — Eileen P Morgan
(74) *Attorney, Agent, or Firm* — Faegre Drinker Biddle & Reath LLP

(57) ABSTRACT

First guide pipes are disposed on both sides of blasting areas, and second guide pipes are disposed on both sides of the blasting area. A wire rod W is inserted through the first guide pipes and the second guide pipes, penetrating in a conveying direction of the wire rod W. The diameter of each of first insertion holes of the first guide pipes and second insertion holes of the second guide pipes is gradually reduced toward the downstream side in the conveying direction. The second guide pipe is installed in a state in which the downstream-side end portion in the conveying direction is inserted into the first insertion hole from the inlet side of the first guide pipe.

15 Claims, 12 Drawing Sheets

(51) Int. Cl.

| | |
|---|---|
| ***B24C 3/10*** | (2006.01) |
| ***B24C 3/32*** | (2006.01) |
| ***B24C 9/00*** | (2006.01) |
| ***B24C 3/14*** | (2006.01) |

(52) U.S. Cl.
CPC ..... *B24C 3/10* (2013.01); *B24C 3/14* (2013.01); *B24C 3/32* (2013.01); *B24C 9/00* (2013.01)

(58) Field of Classification Search
USPC ..... 451/2, 38, 81, 89, 95
See application file for complete search history.

(56) References Cited

U.S. PATENT DOCUMENTS 4,494,607 A * 1/1985 Ford ..... E21B 17/006 166/311
5,312,530 A * 5/1994 Lindwall ..... B05B 13/0207 204/206
5,613,286 A * 3/1997 McCabe ..... B21C 43/04 15/308
5,904,610 A * 5/1999 Ciniglio ..... H02G 1/1285 451/38
6,319,101 B1 * 11/2001 Vago ..... B24C 3/08 451/94
7,040,130 B2 * 5/2006 Liu ..... B21C 37/045 451/38
8,007,563 B1 * 8/2011 Kelson ..... C22B 15/0056 75/715
2003/0010753 A1 * 1/2003 Yamada ..... B23H 7/102 219/69.12
2011/0233172 A1 * 9/2011 Sato ..... B23H 7/105 219/69.15
2016/0008950 A1 * 1/2016 Quan ..... B24C 1/00 451/38
2018/0043408 A1 * 2/2018 Nakano ..... B24C 5/04
2019/0247979 A1 * 8/2019 Umemura ..... B24C 1/10

FOREIGN PATENT DOCUMENTS

CN 102371544 A 3/2012
CN 202448044 U 9/2012
GB 1035535 A * 7/1966 ..... B24C 3/10
GB 1234680 A * 6/1971 ..... B24C 3/12
GB 1247701 9/1971
GB 1247701 A * 9/1971 ..... B24C 9/003
GB 2321344 A * 7/1998 ..... B24C 3/081
JP S55-160734 U 11/1980
JP S58-8567 U 1/1983
JP S62-042958 3/1987
JP S63-151267 U 10/1988
JP 2008-49414 A 3/2008
JP 2010-64187 A 3/2010
JP 2012-35390 A 2/2012
TW 201206637 A1 2/2012

* cited by examiner

SHOT PROCESSING DEVICE

TECHNICAL FIELD

The present disclosure relates to a shot processing device.

BACKGROUND ART

A shot processing device is, for example, a device that conveys a wire rod into a cabinet and blasts shot media onto the surface of the conveyed wire rod. In such a device, it is necessary to minimize vibration and bending of the wire rod caused by the shot media hitting the wire rod.

CITATION LIST

Patent Literature

Patent Literature 1: Japanese Unexamined Patent Publication No. 2008-49414

Patent Literature 2: Japanese Unexamined Patent Publication No. 2012-35390

Patent Literature 3: Specification of Chinese Utility Model Publication No. 201586930

Patent Literature 4: Specification of Chinese Utility Model Publication No. 201645328

SUMMARY OF INVENTION

Technical Problem

For such a problem, for example, Patent Literature 1 discloses a technique of reducing vibration of a wire rod caused by blasting by holding the wire rod with three or more spherical support members. Such a technique has a great effect in processing a soft wire rod and is particularly useful for obtaining high surface quality. However, with this technique, since the spherical support members are always rolled in accordance with traveling of the wire rod, contact portions between the wire rod and support members tend to wear away. It is therefore necessary to thoroughly manage the life of the parts, resulting in a disadvantage that the running cost is increased.

On the other hand, there is a technique in which guide pipes through which a wire rod is inserted are provided on both sides of a blasting area in a conveyance path, and the plurality of guide pipes are adjacently disposed in series (see, for example, Patent Literature 2). With such a technique, the diameter of an insertion hole of the guide pipe is gradually decreased toward the downstream side in a wire rod conveying direction. Therefore, according to such a technique, the wire rod is supported, in a point contact manner, with any of the inner surfaces of the guide pipes depending on the vibration and consequently the guide pipes are relatively hard to wear away, and since the wire rod are supported at a plurality of points by the guide pipes, there is an advantage that vibration and bending of the wire rod are reduced. However, with this technique, it is necessary to align the positions of the insertion holes of the guide pipes, and hence there is a room for improvement in the aspect of easily aligning the positions of the insertion holes of the plurality of guide pipes.

In view of the above facts, it is an object of the present disclosure to provide a shot processing device capable of easily aligning the positions of insertion holes of a plurality of guide pipes and effectively reducing vibration and bending of a wire rod caused by blasting.

Solution to Problem

A shot processing device according to one embodiment of the present disclosure includes: a blasting device configured to blast shot media onto a wire rod which is an object to be processed and conveyed in a predetermined conveying direction; a cabinet including a blasting area in which the wire rod is surface-processed by the shot media blasted by the blasting device, the blasting area being provided inside of the cabinet; first guide pipes disposed on both sides of the blasting area, respectively, each of the first guide pipes having a first insertion hole formed to penetrate in the conveying direction of the wire rod and through which the wire rod is inserted, the first insertion hole having a diameter gradually reduced toward a downstream side in the conveying direction; and a second guide pipe disposed on at least one of both sides of the blasting area and having a second insertion hole formed to penetrate in the conveying direction of the wire rod and through which the wire rod is inserted, the second insertion hole having a diameter gradually reduced toward the downstream side in the conveying direction, the second guide pipe being installed in a state in which a downstream-side end portion in the conveying direction is inserted into the first insertion hole from an inlet side of the first guide pipe.

According to the above configuration, the blasting device blasts the shot media onto the wire rod which is an object to be processed and conveyed in the predetermined conveying direction. The blasting area in which the wire rod is surface-processed by the shot media blasted by the blasting device is provided inside of the cabinet. The first guide pipes are disposed on both sides of the blasting area and have the first insertion hole formed to penetrate in the conveying direction of the wire rod and through which the wire rod is inserted, and the first insertion holes are gradually reduced in diameter toward the downstream side in the conveying direction. Therefore, even when the wire rod receives a load from the shot media at the time of blasting, the wire rod is supported in a point contact manner with the inner side of the first insertion holes of the first guide pipes on both sides of the blasting area.

Here, the second guide pipe is disposed on at least one of both sides of the blasting area and has the second insertion hole formed to penetrate in the conveying direction of the wire rod and through which the wire rod is inserted, and the second insertion hole is gradually reduced in diameter toward the downstream side in the conveying direction. Therefore, when the wire rod receives a load from the shot media at the time of blasting, on at least either of both sides of the blasting area, the wire rod is supported in a point contact manner with the inner side of the first insertion hole of the first guide pipe and the inner side of the second insertion hole of the second guide pipe. Therefore, vibration and bending of the wire rod at the time of blasting are reduced. Moreover, at the time of blasting, since the wire rod is supported in a point contact manner with the inner side of the first insertion hole of the first guide pipe and the inner side of the second insertion hole of the second guide pipe, respectively, while being conveyed, the wear of the portions supporting the wire rod is relatively reduced.

The second guide pipe is installed in a state in which the downstream-side end portion in the conveying direction is inserted into the first insertion hole from the inlet side of the first guide pipe. Therefore, the position of the second insertion hole of the second guide pipe can be easily aligned with the position of the first insertion hole of the first guide pipe.

In one embodiment, a gap for shot media passage may be set at least in a part between a portion of the second guide pipe disposed inside the first guide pipe and an inner surface of the first guide pipe.

According to the above configuration, since the gap for shot media passage is set at least in a part between the portion of the second guide pipe disposed inside the first guide pipe and the inner surface of the first guide pipe, even if the shot media enters into the first guide pipe, it is possible to let the shot media flow out from the gap for shot media passage.

In one embodiment, three or more of the blasting areas are provided and set along the conveying direction of the wire rod, and the second guide pipe may be disposed at least between the blasting areas adjacent to each other.

According to the above configuration, since at least the first guide pipe and the second guide pipe are disposed between the blasting areas adjacent to each other, vibration and bending of the wire rod are effectively reduced.

In one embodiment, the second guide pipe includes: a plurality of convex portions formed on the outer peripheral surface side of the portion disposed inside the first guide pipe, protruding toward the inner surface side of the first guide pipe and coining into contact with the inner surface; a flange portion formed in the upstream-side end portion in the conveying direction and protruding radially outward; and a plurality of positioning holes formed in the flange portion, and, among the first guide pipes, the insert-receiving first guide pipe installed in a state in which the second guide pipe is inserted into the insert-receiving first guide pipe may have a positioning shaft portion protruding toward the upstream side in the conveying direction at an upstream-side end portion in the conveying direction and positioning the axial center of the first insertion hole of the insert-receiving first guide pipe and the axial center of the second insertion hole of the second guide pipe on the same straight line in a state in which the positioning shaft portion is inserted into the positioning hole.

According to the above configuration, in a state in which the plurality of convex portions of the second guide pipe are in contact with the inner surface of the first guide pipe and the positioning shaft portion of the insert-receiving first guide pipe is inserted into the positioning hole of the second guide pipe, the axial center of the first insertion hole of the insert-receiving first guide pipe and the axial center of the second insertion hole of the second guide pipe are positioned on the same straight line. Therefore, the axial center of the first insertion hole of the insert-receiving first guide pipe and the axial center of the second insertion hole of the second guide pipe can be easily and accurately positioned on the same straight line.

In one embodiment, the downstream-side end portion of the first guide pipe in the conveying direction and the upstream-side end portion of the second guide pipe or the other first guide pipe in the conveying direction disposed to face the downstream-side end portion of the first guide pipe in the conveying direction with the blasting area therebetween may be connected with a connection member.

According to the above configuration, since the downstream-side end portion of the first guide pipe in the conveying direction and the upstream-side end portion of the second guide pipe or the other first guide pipe in the conveying direction disposed to face the downstream-side end portion of the first guide pipe in the conveying direction with the blasting area therebetween are connected with the connection member, assembling and maintenance and inspection are easy.

In one embodiment, an upstream-side first guide pipe disposed on a most upstream side in the conveying direction of the wire rod among the first guide pipes is fixed to a first vertical wall portion on the cabinet side, and the shot processing device may include: a pair of mounting rods on which the first guide pipe and the second guide pipe are mounted, the mounting rods extending in the conveying direction of the wire rod and being supported on the cabinet side and disposed parallel to each other with a space between the mounting rods; and a fixed plate member fixed to a second vertical wall portion on the cabinet side in a state in which a downstream-side first guide pipe disposed on a most downstream side in the conveying direction of the wire rod among the first guide pipes is fitted into the fixed plate member.

According to the above configuration, the upstream-side first guide pipe disposed on the most upstream side in the conveying direction of the wire rod among the first guide pipes is fixed to the first vertical wall portion on the cabinet side. The pair of mounting rods extending in the conveying direction of the wire rod are supported on the cabinet side, and the first guide pipe and the second guide pipe are mounted on the pair of mounting rods. Further, the fixed plate member is fixed to the second vertical wall portion on the cabinet side in a state in which the downstream-side first guide pipe disposed on the most downstream side in the conveying direction of the wire rod among the first guide pipes is fitted into the fixed plate member. Thus, the first guide pipe and the second guide pipe can be relatively easily assembled to the cabinet.

In one embodiment, the outer shape of the flange portion of the second guide pipe is a regular hexagon, and the positioning holes may be formed on the same imaginary circle with a center of the regular hexagon as a center point and on straight lines connecting the center and a corner portion on an outer peripheral side of the regular hexagon.

The above configuration can even cope with, for example, the case where two, three, or six of the positioning shaft portions of the insert-receiving first guide pipe are provided at equal intervals in the peripheral direction as seen in the axial direction of the insert-receiving first guide pipe, and therefore it is easy to make the second guide pipe as a common part.

In one embodiment, either of the first guide pipe and the second guide pipe may be supported on the cabinet side through a vibration absorbing member.

According to the above configuration, since either of the first guide pipe and the second guide pipe is supported on the cabinet side through the vibration absorbing member, it is possible to effectively reduce vibration of the wire rod passing through the first guide pipe and the second guide pipe at the time of blasting.

In one embodiment, the cabinet is formed with an inlet opening for carrying in the wire rod and an outlet opening for letting out the wire rod, at least either of an inlet opening side of the cabinet and an outlet opening side of the cabinet is provided with a seal structure portion having an adjacent chamber communicating with an internal space of the cabinet, and the seal structure portion includes a brush body having a brush tip arranged on a center side of a conveyance path of the wire rod as seen in the conveying direction of the wire rod, the brush body being helical about an axis in the conveying direction of the wire rod and elastically deformable.

According to the above configuration, at least either of the inlet opening side and the outlet opening side of the cabinet is provided with the seal structure portion having the adjacent chamber communicating with the internal space of the cabinet. The seal structure portion includes the brush body with the brush tip arranged on the center side of the conveyance path of the wire rod as seen in the conveying direction of the wire rod, and the brush body is helical about the axis in the conveying direction of the wire rod and is elastically deformable. Therefore, the brush tip of the brush body can be brought into contact with the wire rod being conveyed, and consequently leakage of the shot media from the cabinet can be effectively reduced and the wire rod is unlikely bent by the elastic force of the brush body.

Advantageous Effects of Invention

As described above, the shot processing device of the present disclosure has the advantageous effects of easily aligning the positions of the insertion holes of the plurality of guide pipes and effectively reducing vibration and bending of the wire rod caused by the blasting.

BRIEF DESCRIPTION OF DRAWINGS

FIG. 7(A) is an enlarged cross-sectional view showing, in enlargement, a state when cut along the 7A-7A line of FIG. 2. FIG. 7(B) is an enlarged cross-sectional view showing, in enlargement, a state when cut along the 7B-7B line of FIG. 2. FIG. 7(C) is an enlarged cross-sectional view showing, in enlargement, a state when cut along the 7C-7C line of FIG. 2.

FIG. 8(A) is an enlarged longitudinal cross-sectional view showing, in enlargement, a longitudinal cross section of the first seal structure portion in FIG. 1. FIG. 8(B) is a diagram showing a state when cut along the 8B-8B line of FIG. 8(A).

FIG. 9(A) is a perspective view showing a brush body for sealing. FIG. 9(B) is a perspective view showing a state in which the brush body is incorporated in a box body.

DESCRIPTION OF EMBODIMENTS

First Embodiment

Figure 1:
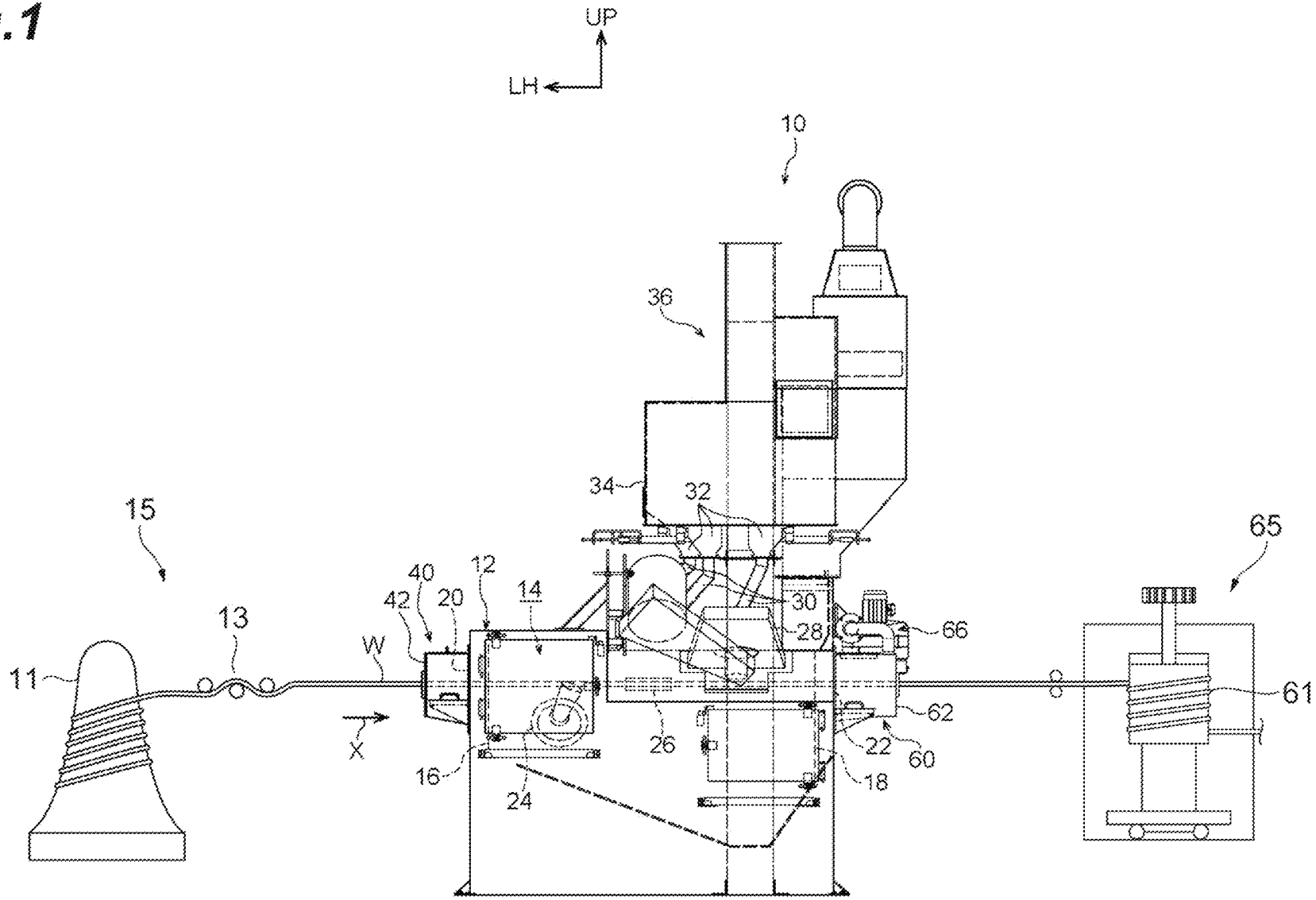
FIG. 1 is a front view showing a shot blasting device according to a first embodiment.

A shot blasting device as a shot processing device according to a first embodiment will be described with reference to FIGS. 1 to 11. An arrow FR shown as appropriate in the drawings indicates the front side in a front view of the device, an arrow UP indicates the upper side of the device, and an arrow LH indicates the left side in the front view of the device.

FIG. 1 shows a front view of a shot blasting device 10. The shot blasting device 10 according to the present embodiment takes a metallic long wire rod W as an object to be processed. The shot blasting device 10 is a device for removing oxide scale and rust generated on the surface of the wire rod W. An arrow X shown as appropriate in the drawings indicates a conveying direction in which the wire rod W is conveyed (hereinafter referred to as the "wire rod conveying direction" as appropriate).

A wire rod supply device 15 as disclosed in the Specification of Chinese Utility Model Publication No. 201586930 is disposed on the upstream side (the left side in the drawing) in the wire rod conveying direction (wire rod traveling direction) with respect to the shot blasting device 10 shown in FIG. 1. The wire rod supply device 15 is a device for supplying a rolled wire rod W to the shot blasting device 10. The wire rod supply device 15 includes an unwinding part 11 on which the wire rod W before being blasted by the shot blasting device 10 is wound in a coil form, and guide rollers 13 for guiding the wire rod W unwound from the unwinding part to the inlet side of the shot blasting device 10 while stretching the wire rod W almost in a straight line (preliminary correction).

Further, a winding device 65 as disclosed in the Specification of Chinese Utility Model Publication No. 201645328 is disposed on the downstream side (the right side in the drawing) in the wire rod conveying direction with respect to the shot blasting device 10. The winding device 65 includes a reel 61 driven to rotate by a driving motor, and is a device for winding up the wire rod W which has been subjected to a blasting process and conveyed out of the shot blasting device 10 by the reel 61 at a predetermined speed and a predetermined tension. Other than the winding device, a drawing machine (that is a device for pulling out the wire rod W to a specified thickness by dies and a device including wire rod travel-driving means for repeating an operation of holding and pulling the wire rod W while reciprocating) or the like is used to convey the wire rod W.

Figure 2:
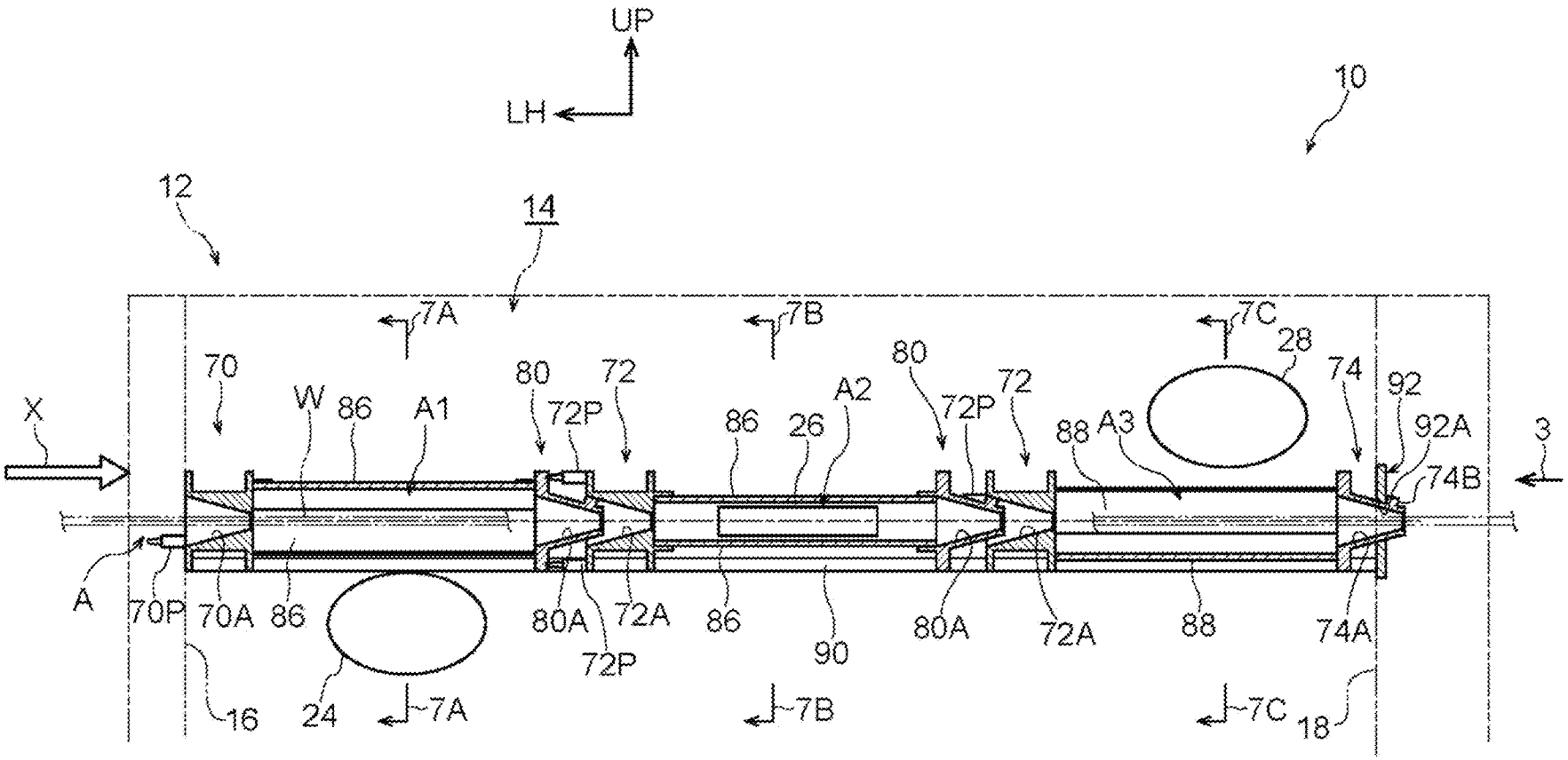
FIG. 2 is a cross-sectional front view of the inside of the device showing a schematic configuration of main components of the shot blasting device of FIG. 1.

As shown in FIG. 1, the shot blasting device 10 includes a cabinet 12. Formed inside the cabinet 12 is a blasting chamber 14 (also called a "processing chamber" or "cleaning chamber") in which the wire rod W is surface-processed by blasting shot media (also referred to as "shots") onto the wire rod W. FIG. 2 is a front view of the shot blasting device 10 showing a schematic configuration of main components of the shot blasting device 10. As shown in FIG. 2, the blasting chamber 14 includes blasting areas A1, A2, A3 in which the wire rod W is surface-processed by the above shot media, and a plurality of blasting areas A1, A2, A3 (three in the present embodiment) are set along the wire rod conveying direction. As shown in FIG. 1, the cabinet 12 has an inlet opening 20 for carrying in the wire rod W, which is formed on the upstream side in the wire rod conveying direction (the left side in the drawing), and an outlet opening 22 for letting out the wire rod W, which is formed on the downstream side in the wire rod conveying direction (the right side in the drawing).

As shown in FIG. 2, in the blasting chamber 14 of the cabinet 12, a first blasting device 24 that blasts the shot media in the blasting area A1, a second blasting device 26 that blasts the shot media in the blasting area A2, and a third blasting device 28 that blasts the shot media in the blasting area A3 are mounted in this order from the upstream side in the conveyance path. Note that in FIG. 2, the first blasting device 24, the second blasting device 26 and the third blasting device 28 are schematically shown for the sake of convenience (this also applies to FIGS. 3 and 7 described later). Each of the first blasting device 24, the second blasting device 26 and the third blasting device 28 is a centrifugal blasting device including a rotatable impeller and capable of blasting the shot media toward the wire rod W with rotation of the impeller.

Note that the type and particle diameter of the shot media applied to the first blasting device 24, the second blasting device 26 and the third blasting device 28 are not limited. For example, when processing a wire rod having many oxide scales and a large amount of rust, shot media having a wide particle size distribution with a particle diameter of 0.3 mm to 0.6 mm may be used in general. As an example, in the case when a 13-mm-diameter wire rod having rust generated on the surface is processed, shot media with a diameter of 0.3 mm to 0.4 mm may be used.

The range in which the shot media are blasted by the first blasting device 24, the second blasting device 26 and the third blasting device 28 is set to be long in accordance with the conveying direction of the wire rod W, and the width in which the shot media are blasted is set to be narrow in accordance with the diameter of the wire rod W. The distance from each of the first blasting device 24, the second blasting device 26 and the third blasting device 28 to the wire rod W is set so that the shot media are most efficiently blasted onto the wire rod W. Note that the number of the blasting devices is set based on specifications, such as the diameter and material of the wire rod and the processing speed of the wire rod.

Figure 3:
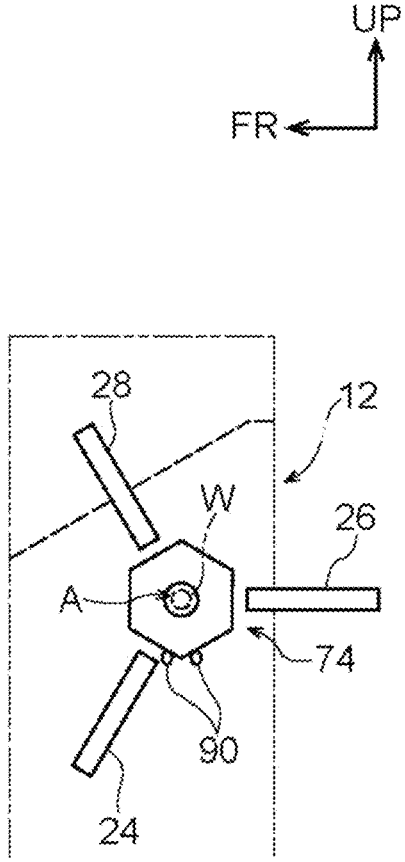
FIG. 3 is a diagram showing, in a simplified and partially perspective manner, a state seen from the direction of arrow 3 in FIG. 2.

FIG. 3 shows, in a simplified and partially perspective manner, a state seen from the direction of arrow 3 in FIG. 2. As shown in FIG. 3, the first blasting device 24, the second blasting device 26 and the third blasting device 28 are set at equiangular positions in the circumferential direction around the axis of the wire rod conveying direction. The first blasting device 24 blasts the shot media toward the wire rod W from the obliquely lower side on one side in a left-right width direction (the left side in the drawing (the front side of the device) in the present embodiment) with respect to a conveyance path A on which the wire rod W is conveyed (from the back side toward the front side of the paper in the drawing). Moreover, the second blasting device 26 blasts the shot media toward the wire rod W from a side on the other side in the left-right width direction (the right side in the drawing (the back side of the device) in the present embodiment) with respect to the conveyance path A. Further, the third blasting device 28 blasts the shot media toward the wire rod W from an obliquely upper side on one side in the left-right width direction (the left side in the drawing (the front side of the device) in the present embodiment) with respect to the conveyance path A.

As shown in FIG. 1, an introduction duct 30 for supplying the shot media are disposed above each of the first blasting device 24, the second blasting device 26 and the third blasting device 28, and a shot supply device 32 is connected to the upper end of the introduction duct 30. Three shot supply devices 32 in total are connected to the lower side of a shot tank 34 for storing the shot media. These shot supply devices 32 include shot gates (not shown), and are devices that supply the shot media to the first blasting device 24, the second blasting device 26 and the third blasting device 28 through the introduction ducts 30 by opening and closing the shot gates. Opening and closing of the shot gates is controlled by an ECU (control device) (not shown).

A circulation device 36 is connected to the first blasting device 24, the second blasting device 26 and the third blasting device 28 through the shot supply devices 32. The circulation device 36 is a device that conveys the shot media blasted by the first blasting device 24, the second blasting device 26 and the third blasting device 28 and circulates the blasting material to the first blasting device 24, the second blasting device 26 and the third blasting device 28. Note that detailed description of the circulation device 36 is omitted.

On the other hand, on the inlet opening 20 side of the cabinet 12, a first seal structure portion 40 (first seal pipe) is provided on the upstream side of the inlet opening 20 in the wire rod conveying direction, and a case body 42 of the first seal structure portion 40 is attached to the cabinet 12. FIG. 8(A) is an enlarged longitudinal cross-sectional view showing, in enlargement, a longitudinal cross section of the first seal structure portion 40, and FIG. 8(B) is a sectional view cut along a line 8B-8B in FIG. 8(A).

As shown in FIG. 8(A), a bottom plate portion 42C of the case body 42 is inclined downward of the device toward the downstream side in the wire rod conveying direction so that, if the shot media enter into the case body 42, it is possible to drop the shot media toward the cabinet 12 side. Note that the lower portion of the internal space of the case body 42 and the internal space of the cabinet 12 communicate with each other. Further, a lid body 42D is detachably attached to an upper end opening portion of the case body 42.

In the case body 42 of the first seal structure portion 40, a through-hole 42A is formed on the upstream side in the wire rod conveying direction, and a through-hole 42B is formed on the downstream side in the wire rod conveying direction. The first seal structure portion 40 includes a front apron chamber 42S serving as an adjacent chamber communicating with the internal space of the cabinet 12.

A guide pipe member (guide member) 44 is disposed in the through-hole 42A on the upstream side of the case body 42 at an opposite portion to the inlet opening 20 of the cabinet 12. The guide pipe member 44 is formed in a substantially cylindrical shape and fixed to the case body 42. A guide hole 44A formed in the guide pipe member 44 is gradually reduced in diameter toward the downstream side in the wire rod conveying direction and disposed so that the axial center of the guide hole 44A coincides with the center line of the conveyance path A of the wire rod W. Further, a guide pipe member (guide member) 46 is disposed on the downstream side of the case body 42. The guide pipe member 46 has substantially the same shape as the guide pipe member 44 disposed on the upstream side of the case body 42 and is disposed so that the axial center of the guide pipe member 46 coincides with the axis of the guide pipe member 44. Since the guide holes 44A and 46A are narrowed on the outlet side, the guide pipe members 44 and 46 also perform the function of reducing shaking of the wire rod W during conveyance.

A first seal portion 48 is provided between the guide pipe member 44 and the guide pipe member 46. The first seal portion 48 includes a box body 50 that allows the wire rod W to pass through inside the box body 50, and a brush body 52 incorporated inside the box body 50.

Figure 8:
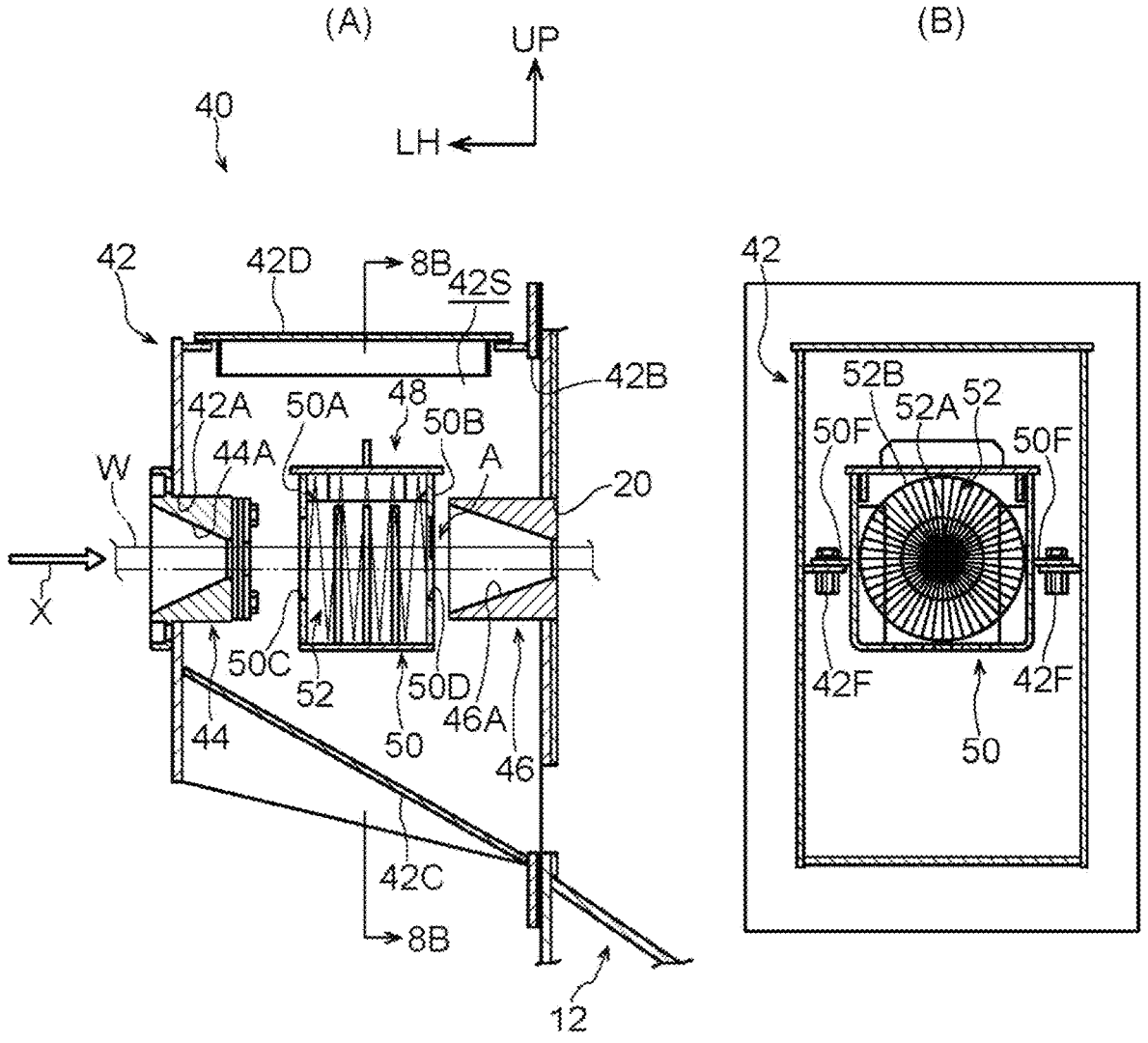
FIG. 8 is a diagram for explaining a first seal structure portion in FIG. 1.
Figure 9:
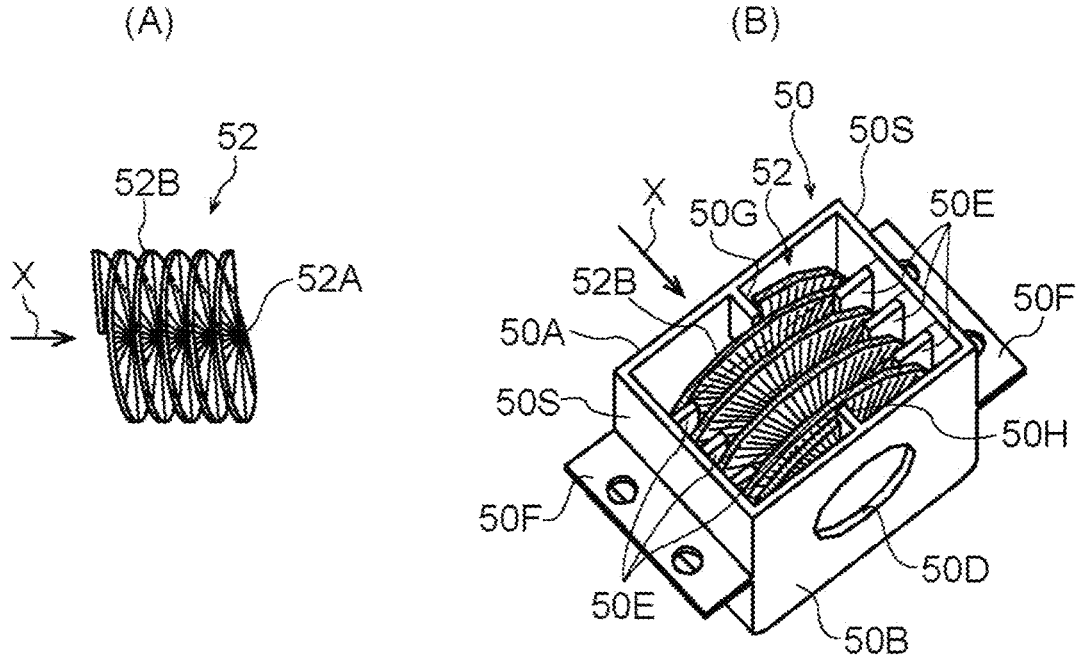
FIG. 9 is a diagram for explaining the main components of the first seal structure portion in FIG. 1.

FIG. 9 is a diagram for explaining the main components of the first seal structure portion 40, wherein FIG. 9(A) shows a perspective view of the brush body 52 for sealing and FIG. 9(B) is a perspective view showing a state in which the brush body 52 is incorporated into the box body 50. As shown in FIG. 9(B), flange portions 50F protrude from a pair of left and right side wall portions 50S of the box body 50. As shown in FIG. 8(B), the flange portions 50F of the box body 50 are bolted to inner flange portions 42F of the case body 42. Further, as shown in FIGS. 8(A) and 9(B), through-holes 50C and 50D for the conveyance path are formed on vertical wall portions 50A and 50B of the box body 50 at both ends in the wire rod conveying direction.

As shown in FIG. 8(B), the brush body 52 has a brush tip 52A set on the center side of the conveyance path of the wire rod W (see FIG. 8(A)) as seen in the conveying direction of the wire rod W (see FIG. 8(A)). Note that FIG. 8 and FIG. 9 show the brush body 52 in a simplified manner. In FIG. 8(B), the circular outer portion indicates a brush proximal end portion 52B, and the circular center portion indicates the brush tip 52A. As shown in FIGS. 9(A) and 9(B), the brush body 52 has a helical shape around the axis of the conveying direction (see arrow X) of the wire rod W (see FIG. 8(A)) and is elastically deformable. As shown in FIG. 9(B), the brush body 52 is inserted into the box body 50, and can be easily attached to and detached from the box body 50. The structure inside the box body 50 will be described. Ribs 50G and 50H for regulating the front and rear ends of the brush body 52 are formed and protrude on the inner surface side of the vertical wall portions 50A and 50B of the box body 50, and a plurality of ribs 50E for regulating the position of brush body 52 are formed on the inner surface side of the pair of side wall portions 50S of the box body 50.

Figure 10:
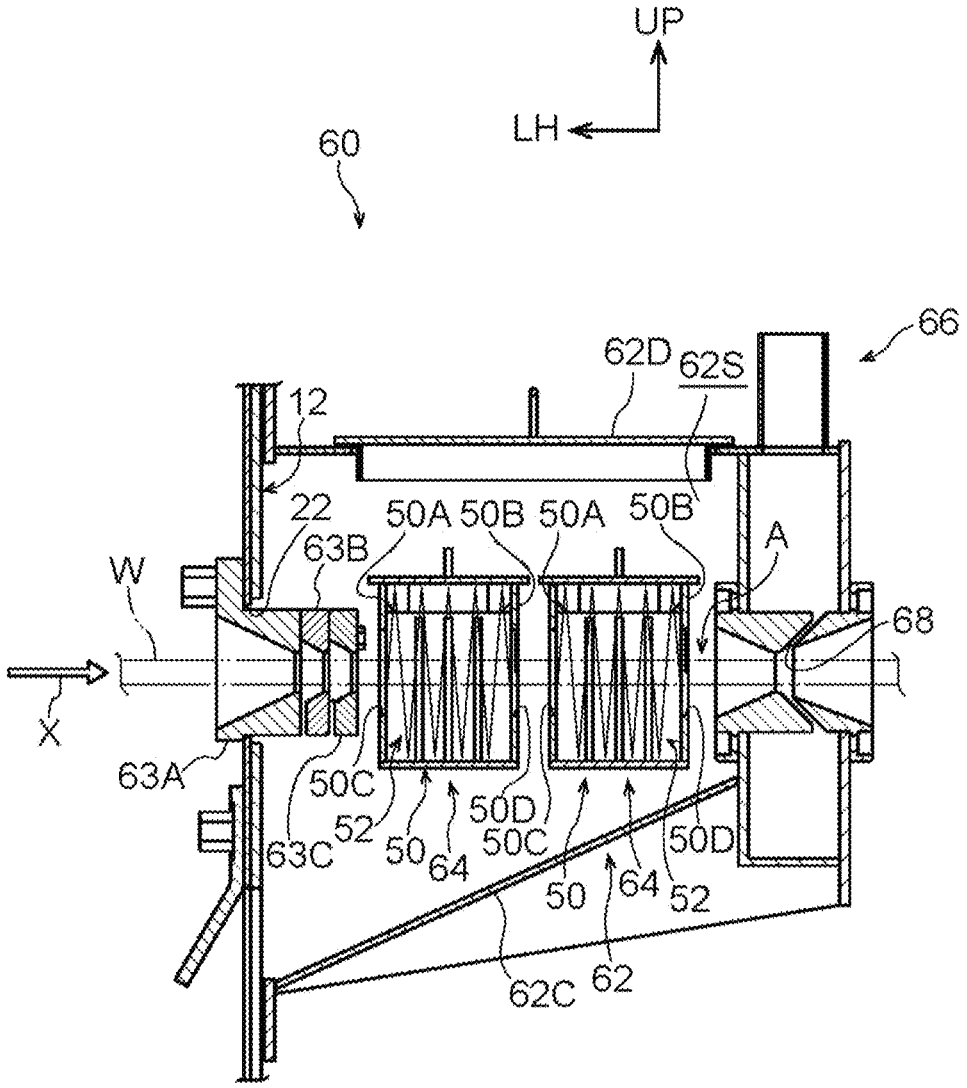
FIG. 10 is an enlarged longitudinal cross-sectional view showing, in enlargement, a longitudinal cross section of a second seal structure portion in FIG. 1.

As shown in FIG. 1, on the outlet opening 22 side of the cabinet 12, a second seal structure portion 60 (second seal pipe) is provided on the downstream side of the outlet opening 22 in the wire rod conveying direction, and a case body 62 of the second seal structure portion 60 is attached to the cabinet 12. FIG. 10 is an enlarged longitudinal cross-sectional view showing, in enlargement, a longitudinal cross section of the second seal structure portion 60.

As shown in FIG. 10, a bottom plate portion 62C of the case body 62 is inclined downward of the device toward the upstream side in the wire rod conveying direction, and if the shot media enter into the case body 62, it is possible to drop the shot media toward the cabinet 12 side. A lower portion of the internal space of the case body 62 and the internal space of the cabinet 12 communicate with each other. Moreover, a lid body 62D is detachably attached to an upper end opening portion of the case body 62.

The case body 62 of the second seal structure portion 60 penetrates in the wire rod conveying direction, and the inside of the case body 62 of the second seal structure portion 60 serves as an adjacent chamber, namely a shot blow down chamber 62S, communicating with the internal space of the cabinet 12. On the upstream side of the case body 62, guide pipes 63A, 63B, 63C are disposed in series. Guide holes foamed in the guide pipes 63A, 63B, 63C, respectively, are gradually reduced in diameter toward the downstream side in the wire rod conveying direction, and the axial center of the guide holes is aligned with the center line of the conveyance path A of the wire rod W. A second seal portion 64 is provided in the case body 62 of the second seal structure portion 60. A plurality of (two in the present embodiment) second seal portions 64 are disposed in series along the wire rod conveying direction. The second seal portion 64 has the same structure as the first seal portion 48 shown in FIG. 8(A). Therefore, the same components of the second seal portion 64 shown in FIG. 10 as the components of the first seal portion 48 shown in FIG. 8(A) are labelled with the same reference signs, and description is omitted.

As shown in FIG. 1, an airflow generator 66 is provided on the upper side of the second seal structure portion 60. As shown in FIG. 10, a blow outlet 68 constituting an air outlet of the airflow generator 66 is disposed on the downstream side of the second seal portion 64 in the wire rod conveying direction. Note that the configuration of the airflow generator 66 is well known, for example, by Japanese Unexamined Patent Publication No. 2012-35390, and therefore detailed description will be omitted.

As shown in FIG. 2, inside the cabinet 12, first guide pipes 70, 72, 74 are disposed on both sides of the blasting areas A1, A2, A3 where the wire rod W is surface-processed by the shot media. In the following description, the first guide pipe 70 disposed on the most upstream side in the conveying direction of the wire rod W among the first guide pipes 70, 72, 74 is referred to as the upstream-side first guide pipe as appropriate, and the first guide pipe 74 disposed on the most downstream side in the conveying direction of the wire rod W among the first guide pipes 70, 72, 74 is referred to as the downstream-side first guide pipe as appropriate. Further, in the present embodiment, the first guide pipe 72 disposed between the upstream-side first guide pipe 70 and the downstream-side first guide pipe 74 among the first guide pipes 70, 72, 74 is an insert-receiving first guide pipe to be described in detail later, and a total of two first guide pipes 72 are provided. Formed in the first guide pipes 70, 72, 74 are first insertion holes 70A, 72A, 74A penetrating in the conveying direction of the wire rod W and allowing insertion of the wire rod W therethrough. The first insertion holes 70A, 72A, 74A are gradually reduced in diameter toward the downstream side in the conveying direction, and the inner diameter on the outlet side is set smaller than the inner diameter on the inlet side. The diameter of the outlet of each of the first insertion holes 70A, 72A, 74A is larger than the diameter of the wire rod W.

Second guide pipes 80 are disposed on both sides of the blasting area A2 (on the downstream side of the blasting area A1 in the wire rod conveying direction that is one of both sides of the blasting area A1, and on the upstream side of the blasting area A3 in the wire rod conveying direction that is one of both sides of the blasting area A3). Namely, the second guide pipes 80 are disposed between the blasting area A1 and the blasting area A2 adjacent to each other, and between the blasting area A2 and the blasting area A3 adjacent to each other. Each of the second guide pipes 80 is formed with a second insertion hole 80A penetrating in the conveying direction of the wire rod W and allowing insertion of the wire rod W therethrough. The second insertion holes 80A are gradually reduced in diameter toward the downstream side in the conveying direction, and the inner diameter on the outlet side is set smaller than the inner diameter on the inlet side. The diameter of the outlet of the second insertion holes 80A is larger than the diameter of the wire rod W.

The second guide pipe 80 is installed in a state in which a downstream-side end portion in the conveying direction is inserted from the inlet side of the insert-receiving first guide pipe 72 into the first insertion hole 72A. Note that among the first guide pipes 70, 72, 74, a first guide pipe which is installed in a state in which the second guide pipe 80 is inserted into the first guide pipe is called the insert-receiving first guide pipe 72. The axial center of the first insertion holes 70A, 72A, 74A and the axial center of the second insertion holes 80A are aligned with the center line of the conveyance path A. The distance between the outlet of the first insertion hole 72A of the insert-receiving first guide pipe 72 and the outlet of the second insertion hole 80A of the second guide pipe 80 inserted into the insert-receiving first guide pipe 72 is set longer than the diameter of the outlet of the first insertion hole 72A and the diameter of the outlet of the second insertion hole 80A.

Figure 4:
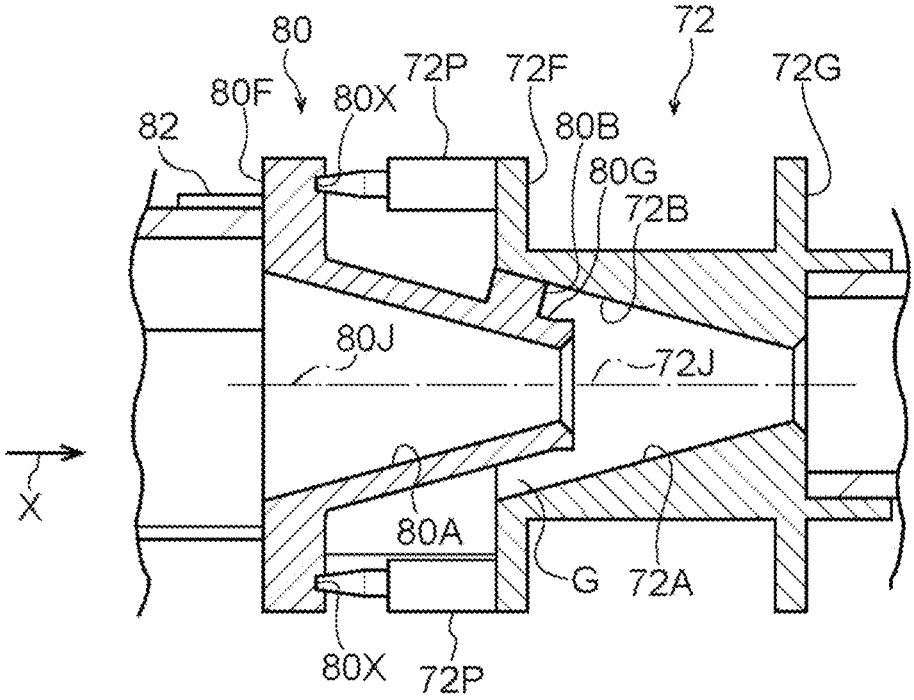
FIG. 4 is an enlarged longitudinal cross-sectional view showing, in enlargement, a state in which a second guide pipe is inserted and installed in an insert-receiving first guide pipe.

FIG. 4 is an enlarged longitudinal cross-sectional view showing, in enlargement, the installation state in which the second guide pipe 80 is inserted into the insert-receiving first guide pipe 72. As shown in FIG. 4, a gap G for shot media passage is set in a part between a portion of the second guide pipe 80 disposed inside the insert-receiving first guide pipe 72 and the inner surface 72B of the insert-receiving first guide pipe 72.

Figure 5:
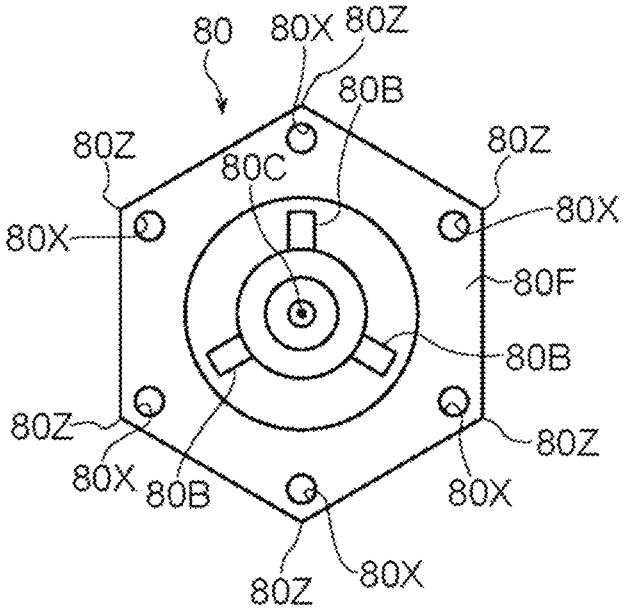
FIG. 5 is a diagram showing the second guide pipe seen from the outlet side.

FIG. 5 shows a state of the second guide pipe 80 seen from the outlet side. As shown in FIGS. 4 and 5, in the second guide pipe 80, a plurality of (a total of three in the present embodiment) convex portions 80B are formed on an outer peripheral surface 80G side of the portion disposed inside the insert-receiving first guide pipe 72. The convex portions 80B protrude toward the inner surface 72B side of the insert-receiving first guide pipe 72 and are in contact with the inner surface 72B. Further, a flange portion 80F protruding radially outward is formed at the end portion of the second guide pipe 80 on the upstream-side end portion in the conveying direction. A plurality of positioning holes 80X are formed in the flange portion 80F. As shown in FIG. 5, the outer shape of the flange portion 80F of the second guide pipe 80 is a regular hexagon, and the positioning holes 80X are formed on the same imaginary circle centered on a center 80C of the regular hexagon and on straight lines connecting the center 80C and corner portions 80Z on the outer periphery side of the regular hexagon.

As shown in FIG. 4, in the insert-receiving first guide pipe 72, a first flange portion 72F protruding radially outward is formed at an upstream-side end portion in the conveying direction, and a second flange portion 72G protruding radially outward is formed at a downstream-side end portion in the conveying direction. The outer shape of the second flange portion 72G is a regular hexagon as seen in the direction of an axial center 72J of the insert-receiving first guide pipe 72 (see FIGS. 7(B) and 7(C)), and the first flange portion 72F has the same outer shape. On the first flange portion 72F of the insert-receiving first guide pipe 72, a pair of positioning shaft portions 72P protruding toward the upstream side in the conveying direction are provided. The pair of positioning shaft portions 72P are set on both sides (both the upper and lower sides in FIG. 4) of the axial center 72J as seen in the direction of the axial center 72J of the insert-receiving first guide pipe 72. The distal end side of the positioning shaft portions 72P is gradually reduced in diameter toward the upstream side in the conveying direction. When the positioning shaft portions 72P are inserted into the positioning holes 80X, the positioning shaft portions 72P serve to position the axial center 72J of the first insertion hole 72A of the insert-receiving first guide pipe 72 and an axial center 80J of the second insertion hole 80A of the second guide pipe 80 on the same straight line. On the other hand, in the present embodiment, the upstream-side first guide pipe 70 shown in FIG. 2 is a component having the same shape as the insert-receiving first guide pipe 72.

Note that, for the first guide pipes 70, 72, 74 and the second guide pipes 80, parameters such as shapes, material and mass are set to secure the wire inserting position of the wire rod W and effectively prevent vibration, bending, meandering and shaking of the wire rod W at the time of blasting. The first guide pipes 70, 72, 74 and the second guide pipes 80 are made of a highly wear-resistant material (one example is special cast steel) which is hard to abrade even when the shot media hit the material. The first guide pipes 70, 72, 74 and the second guide pipes 80 which are arranged in order in the wire rod conveying direction do not necessarily use the same material or have the same surface hardness and may have different properties.

As shown in FIG. 2, the downstream-side end portions of the first guide pipes 70, 72 in the conveying direction disposed on the upstream side of the blasting areas A1, A2 in the conveying direction and the upstream-side end portion of each of the second guide pipes 80 in the conveying direction disposed to face the downstream-side end portions of the first guide pipes 70, 72 in the conveying direction with the blasting area A1 or A2 therebetween are connected with connection plates 86 as a connection member. Further, the downstream-side end portion of the first guide pipe 72 in the conveying direction disposed on the upstream side of the blasting area A3 in the conveying direction and the upstream-side end portion in the conveying direction of the first guide pipe 74 disposed to face the downstream-side end portion of the first guide pipe 72 in the conveying direction with the blasting area A3 therebetween are connected with connection plates 88 as a connection member. A highly wear-resistant material which is hard to abrade even when the shot media hit the material (one example is special cast steel) is used for the connection plates 86 and 88.

Figure 6:
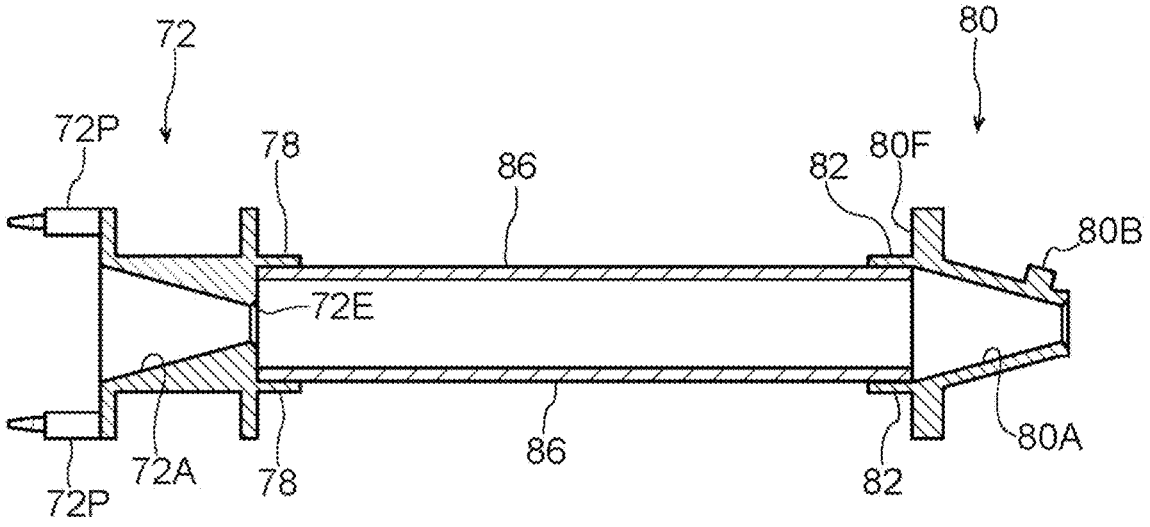
FIG. 6 is a cross-sectional view showing a state in which the first guide pipe and the second guide pipe are connected by a connection plate.
Figure 7:
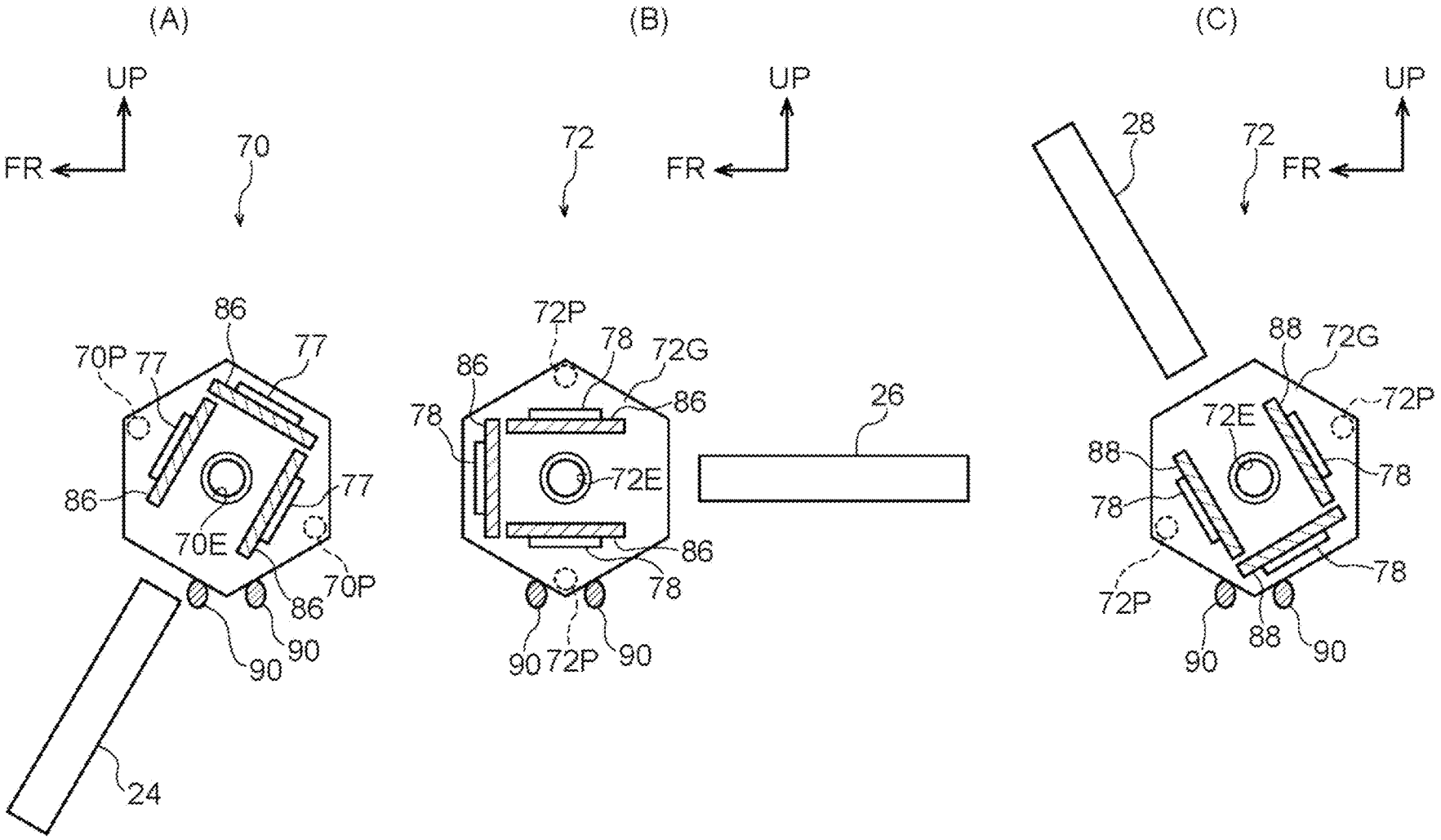
FIG. 7 is a cross-sectional view corresponding to the direction of arrow 3 in FIG. 2.

FIG. 6 is a cross-sectional view showing a state in which the first guide pipe 72 and the second guide pipe 80 are connected with the connection plates 86. FIG. 7(A) is an enlarged cross-sectional view showing, in enlargement, a state when cut along the 7A-7A line in FIG. 2, FIG. 7(B) shows an enlarged cross-sectional view showing, in enlargement, a state when cut along the 7B-7B line in FIG. 2, and FIG. 7(C) shows an enlarged cross-sectional view showing, in enlargement, a state when cut along the 7C-7C line in FIG. 2. Note that the structure in which the first guide pipe 70 and the second guide pipe 80 are connected with the connection plates 86 shown in FIG. 2 and the structure in which the first guide pipe 72 and the first guide pipe 74 are connected with the connection plates 88 are the same as the structure shown in FIG. 6, but as shown in FIG. 7, there are differences in the postures or the like of the connection plates 86 and 88 (to be described in detail later).

As shown in FIG. 7, for example, three pieces of connection plates 86, 88 are used to connect one set, and fixed with bolts (not shown) to attachment portions 77, 78 formed and protruding on the surfaces of the first guide pipes 70, 72 facing the conveyance downstream side. Each of the attachment portions 77 and 78 has a rectangular block shape and protrudes toward the conveyance downstream side. For example, the attachment portions 77 and 78 include ones that are disposed on both sides to oppose to each other with outlets 70E, 72E of the first guide pipes 70, 72 therebetween, and one which is disposed on one side in a direction orthogonal to the opposing direction and extends in the opposing direction.

In contrast, at the upstream-side end portion in the conveying direction of the second guide pipe 80 shown in FIG. 6, attachment portions 82 are formed at the opposing positions to the attachment portions 78, respectively (see FIG.

7(B)). Note that the downstream-side first guide pipe 74 shown in FIG. 2 is a component having the same shape as the second guide pipe 80.

On the other hand, as shown in FIG. 7, the three pieces of connection plates 86, 88 used for connecting one set are disposed so that one direction is open as seen from the conveyance path A, and this open side is set in accordance with the blasting directions of the first blasting device 24, the second blasting device 26 and the third blasting device 28 respectively. In the present embodiment, when the first guide pipes 70, 72, 74 and the second guide pipes 80 (see FIG. 2) are rotated about the respective axes, the direction of the open side can be changed. Further, supplemental description will be given with reference to FIGS. 5 and 6. The placement angle of the connection plates 86 can be easily changed depending on which of the six positioning holes 80X shown in FIG. 5 the positioning shaft portions 72P shown in FIG. 6 are inserted.

As shown in FIGS. 2 and 3, the first guide pipes 70, 72, 74 and the second guide pipes 80 are mounted on a pair of left and right mounting rods 90. The portions of the first guide pipes 70, 72, 74 and the second guide pipes 80 which are mounted on the mounting rods 90 are in the shape of regular hexagon as seen in the wire rod conveying direction (see FIGS. 3 and 7, etc.), and the first guide pipes 70, 72, 74 and second guide pipes 80 are disposed not to be rotatable about the axis on the mounting rods 90. The pair of left and right mounting rods 90 extend in the conveying direction of the wire rod W, are disposed parallel to each other with a space between the mounting rods 90 and are supported on the cabinet 12 side by fixing the end portion sides in the longitudinal direction to the first vertical wall portion 16 and the second vertical wall portion 18 of the cabinet 12 shown in FIG. 2.

In addition, the upstream-side first guide pipe 70 is fixed to the first vertical wall portion 16 by inserting a shaft-like portion 70P (the portion having the same shape as the positioning shaft portion 72P of the insert-receiving first guide pipe 72) into a positioning hole of the first vertical wall portion 16 on the cabinet 12 side. On the other hand, the portion of the conveyance downstream side of the downstream-side first guide pipe 74 is inserted into a through-hole 92A of a fixed plate member 92. Note that, in the through-hole 92A of the fixed plate member 92, a cut-out portion (not shown) through which a convex portion 74B of the downstream-side first guide pipe 74 can pass is formed. After the convex portion 74B passes through the cut-out portion, the fixed plate member 92 is rotated about the axis of the downstream-side first guide pipe 74, whereby the convex portion 74B functions as a stopper. In a state in which the downstream-side first guide pipe 74 is fitted into the fixed plate member 92, the fixed plate member 92 is fixed through a spacer (not shown) to the second vertical wall portion 18 on the cabinet 12 side using bolts or the like.

Note that, when assembling the first guide pipes 70, 72, 74 and the second guide pipes 80, the connection plates 86 are connected to the first guide pipes 70, 72 and the second guide pipes 80 in advance as shown in FIG. 2, and the connection plates 88 are connected to the first guide pipe 72 and the first guide pipe 74 in advance. When assembling the first guide pipes 70, 72, 74 and the second guide pipes 80, the upstream-side first guide pipe 70 shown in FIG. 2 is fixed to the first vertical wall portion 16 of the cabinet 12 and the insert-receiving first guide pipe 72 is assembled to the second guide pipe 80 on the conveyance upstream side and mounted sequentially on the mounting rods 90 while being connected to each other, the axial center of the first guide pipes 70, 72, 74 and the axial center of the second guide pipes 80 are aligned with the center line of the conveyance path, and then, after fitting the fixed plate member 92 to the downstream-side first guide pipe 74, the fixed plate member 92 is fixed to the second vertical wall portion 18 of the cabinet 12.

Function/Effects

Next, the function and effects of the above embodiment will be described.

As shown in FIG. 2, in the present embodiment, first guide pipes 70, 72, 74 are disposed on both sides of the blasting areas A1, A2, A3, and the first guide pipes 70, 72, 74 are formed with first insertion holes 70A, 72A, 74A penetrating in the conveying direction of the wire rod W and through which the wire rod W is inserted. The first insertion holes 70A, 72A, 74A are gradually reduced in diameter toward the downstream side in the conveying direction. Therefore, even when the wire rod W receives a load from the shot media at the time of blasting, the wire rod W is supported in a point contact manner with the inner side of each of the first insertion holes 70A, 72A, 74A of the first guide pipes 70, 72, 74 on the both sides of the blasting areas A1, A2 and A3.

Figure 11:
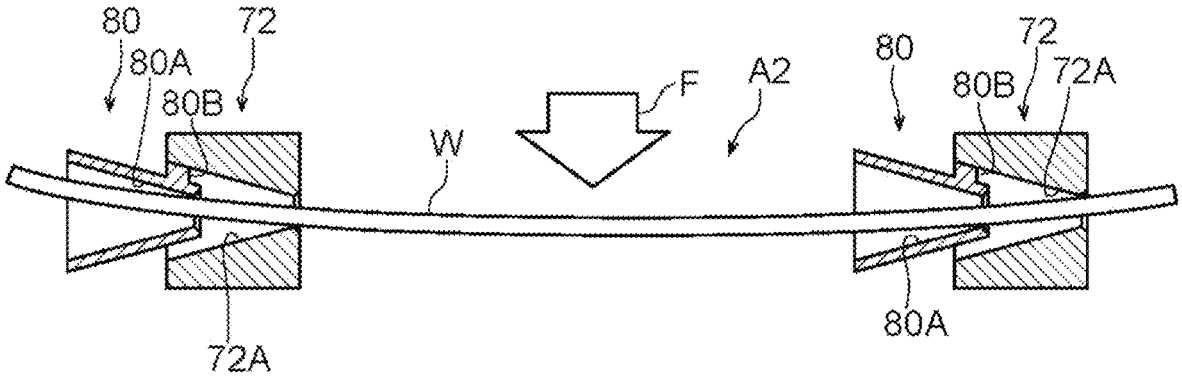
FIG. 11 is a longitudinal cross-sectional view schematically showing a state at the time of blasting.

Here, the second guide pipes 80 are disposed on both sides of the blasting area A2, and each of the second guide pipes 80 is formed with the second insertion hole 80A penetrating in the conveying direction of the wire rod W and through which the wire rod W is inserted. The second insertion holes 80A are gradually reduced in diameter toward the downstream side in the conveying direction. Therefore, as schematically shown in FIG. 11, when the wire rod W receives a load F from the shot media at the time of blasting, the wire rod W is supported in a point contact manner with the inner side of the first insertion hole 72A of the first guide pipe 72 and the inner side of the second insertion hole 80A of the second guide pipe 80 on both sides of the blasting area A2. Consequently, vibration, bending, meandering, etc. of the wire rod W at the time of blasting is reduced. Further, at the time of blasting, since the wire rod W is supported in a point contact manner with the inner side of the first insertion hole 72A of the first guide pipe 72 and the inner side of the second insertion hole 80A of the second guide pipe 80 while being conveyed, the wear of the portions supporting the wire rod W is relatively reduced.

Note that in the present embodiment, as shown in FIG. 2, in addition to the first guide pipe 72, the second guide pipe 80 is disposed on one of both sides of each of the blasting areas A1 and A3. In other words, in the present embodiment, the second guide pipe 80 is disposed between the blasting area A1 and the blasting area A2 which are adjacent to each other and between the blasting area A2 and the blasting area A3 which are adjacent to each other. Therefore, not only when the wire rod W receives a load from the shot media in the blasting area A2 at the time of blasting, but also when the wire rod W receives a load from the shot media in the blasting area A1 and the blasting area A3 at the time of blasting, vibration and bending of the wire rod W are effectively reduced.

Moreover, as shown in FIG. 2, etc., the second guide pipe 80 is installed in a state in which the downstream-side end portion in the conveying direction is inserted into the first insertion hole 72A from the inlet side of the first guide pipe 72. It is therefore possible to easily align the position of the second insertion hole 80A of the second guide pipe 80 with the position of the first insertion hole 72A of the first guide pipe 72.

In the present embodiment, as shown in FIG. 4, since the gap G for shot media passage is set in a part between the portion of the second guide pipe 80 disposed inside the first guide pipe 72 and the inner surface 72B of the first guide pipe 72, even if the shot media enter into the first guide pipe 72, it is possible to let the shot media flow out from the gap G for shot media passage.

In the present embodiment, as shown in FIGS. 4 and 5, in a state in which a plurality of convex portions 80B of the second guide pipe 80 are in contact with the inner surface 72B of the first guide pipe 72 and the positioning shaft portions 72P of the insert-receiving first guide pipe 72 are inserted into the positioning holes 80X of the second guide pipe 80, the axial center 72J of the first insertion hole 72A of the insert-receiving first guide pipe 72 and the axial center 80J of the second insertion hole 80A of the second guide pipe 80 are positioned on the same straight line. Therefore, the axial center 72J of the first insertion hole 72A and the axial center 80J of the second insertion hole 80A can be easily and accurately positioned on the same straight line. Moreover, with such a structure, disassembling is easy, and many types of tools are not required at the time of assembling or disassembling because a smaller number of bolts and nuts are used, and thus there is also an advantage that the working time at the time of assembling or disassembling can be shortened.

Further, in the present embodiment, as shown in FIG. 2, the downstream-side end portions in the conveying direction of the first guide pipes 70, 72 disposed on the upstream side of the blasting areas A1, A2 in the conveying direction and the upstream-side end portions in the conveying direction of the second guide pipes 80 disposed to face the downstream-side end portions of the first guide pipes 70, 72 in the conveying direction with the blasting areas A1, A2 therebetween are connected with the connection plates 86. Moreover, the downstream-side end portion in the conveying direction of the first guide pipe 72 disposed on the upstream side of the blasting area A3 in the conveying direction and the upstream-side end portion in the conveying direction of the first guide pipe 74 disposed to face the downstream-side end portion of the first guide pipe 72 in the conveying direction with the blasting area A3 therebetween are connected with the connection plates 88. Thus, assembling, maintenance and inspection are easy.

In the present embodiment, as shown in FIG. 2, the upstream-side first guide pipe 70 is fixed to the first vertical wall portion 16 on the cabinet 12 side. Further, as shown in FIGS. 2 and 3, a pair of left and right mounting rods 90 extending in the conveying direction of the wire rod W are supported on the cabinet 12 side, and the first guide pipes 70, 72, 74 and the second guide pipes 80 are mounted on the pair of left and right mounting rods 90. In addition, as shown in FIG. 2, the fixed plate member 92 is fixed to the second vertical wall portion 18 on the cabinet 12 side in the state in which the downstream-side first guide pipe 74 is fitted into the fixed plate member 92. Thus, the first guide pipes 70, 72, 74 and the second guide pipes 80 can be relatively easily assembled to the cabinet 12.

In the present embodiment, as shown in FIG. 5, the outer shape of the flange portion 80F of the second guide pipe 80 is a regular hexagon, and the positioning holes 80X are formed on the same imaginary circle (not shown) with the center 80C of the regular hexagon as the center point of the circle and on straight lines (not shown) connecting the center 80C and corner portions 80Z on the outer peripheral side of the regular hexagon. Therefore, the present embodiment can even cope with the case, for example, where two, three, or six of the positioning shaft portions 72P of the insert-receiving first guide pipe 72 shown in FIG. 4 are provided at equal intervals in a peripheral direction as seen in the axial direction of the insert-receiving first guide pipe 72, and it is easy to make the second guide pipe 80 as a common part.

As described above, according to the shot blasting device 10 shown in FIG. 2 of the present embodiment, it is possible to easily align the position of the first insertion hole 72A of the first guide pipe 72 and the position of the second insertion hole 80A of the second guide pipe 80, and it is possible to effectively reduce vibration and bending of the wire rod W caused by the blasting. As a result, for example, it is possible to reduce the number of times a brake device (not shown) is operated in order to control the rotational speed of the unwinding part 11 of the wire rod supply device 15 disposed on the upstream side of the shot blasting device 10 in the conveying direction.

Moreover, in the present embodiment, as shown in FIG. 8, the first seal structure portion 40 including the front apron chamber 42S communicating with the internal space of the cabinet 12 is provided on the inlet opening 20 side of the cabinet 12. Further, as shown in FIG. 10, the second seal structure portion 60 including the shot blow down chamber 62S communicating with the internal space of the cabinet 12 is provided on the outlet opening 22 side of the cabinet 12. As shown in FIGS. 8 and 10, the first seal structure portion 40 and the second seal structure portion 60 include the brush body 52 with the brush tip 52A (see FIG. 8 (B)) set on the center side in the conveyance path A of the wire rod W as seen in the conveying direction of the wire rod W, and the brush body 52 is in the form of helical about the axis of the conveying direction of the wire rod W and is elastically deformable. Therefore, the brush tip 52A side of the brush body 52 can be brought into contact with the wire rod W being conveyed, and consequently leakage of the shot media from the cabinet 12 can be effectively reduced and the wire rod W is unlikely bent by the elastic force of the brush body 52.

A supplemental explanation will be provided. For example, in a comparative configuration of the seal structure disclosed in FIGS. 3 to 6 of Japanese Unexamined Patent Publication No. 2012-35390, it is considered that if a thin wire rod with a predetermined diameter or less is once displaced from the brush cut-out portion and passed through, the wire rod itself may be bent by the elastic restoring force of the intersecting brush and it is difficult for the wire rod to return to the center (center line) of the regular conveyance path. In this case, it is conceivable to decrease the resistance of the brush by reducing the number of pieces of brush to be used or thinning the diameter of the brush. However, when this method is applied, the shot seal ability is decreased, and the brush life is also shortened. In the comparative configuration, it is therefore difficult to set a suitable brush. On the other hand, in the present embodiment, there is no such disadvantage.

Second Embodiment

Figure 12:
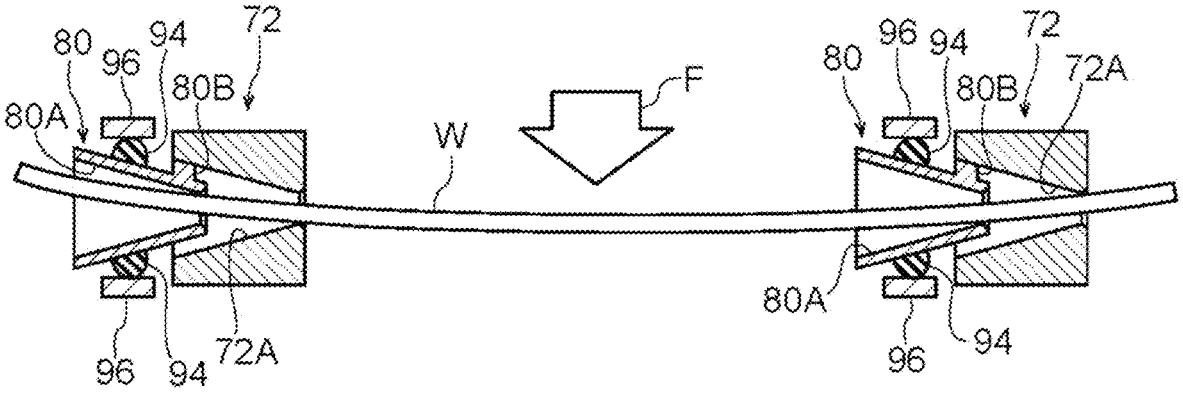
FIG. 12 is a longitudinal cross-sectional view schematically showing a state at the time of blasting according to a second embodiment.

Next, a second embodiment of the present disclosure will be described with reference to FIG. 12. FIG. 12 is a schematic longitudinal cross-sectional view (a view corresponding to FIG. 11 of the first embodiment) showing a state at the time of blasting according to the present embodiment. As shown in FIG. 12, the second guide pipes 80 are different from the first embodiment because the second guide pipes 80 are supported by brackets 96 fixed through vibration absorbing members 94 to the cabinet 12 side (see FIG. 1, etc.). Other structure is the same as the structure of the first embodiment. Therefore, the same reference numerals are given to the same components as the components of the first embodiment, and description will be omitted.

One example of the vibration absorbing member 94 is made of rubber having super heat resistance. However, a vibration absorbing member made of a steel spring may be disposed in place of the rubber vibration absorbing member 94. Further, for example, although the vibration absorbing members 94 are disposed intermittently (discontinuously) on the outer peripheral side of the second guide pipe 80, the vibration absorbing members 94 may be disposed continuously on the outer peripheral side of the second guide pipe 80. According to the configuration of the present embodiment, it is possible to effectively reduce vibration or the like of the wire rod W passing through the first guide pipes 72 and the second guide pipes 80 at the time of blasting.

Supplemental Explanation of Embodiment

As a modified example of the above first embodiment, it is possible to adopt a configuration in which the second guide pipe is inserted into the first guide pipe equivalent to one or both of the upstream-side first guide pipe 70 and the downstream-side first guide pipe 74 shown in FIG. 2. The material and the mass of the first guide pipe and the second guide pipe can be appropriately set by taking into account the vibration reducing effect, etc.

In the above embodiment, as shown in FIG. 4, the gap G for shot media passage is set in a part between the portion of the second guide pipe 80 disposed inside the first guide pipe 72 and the inner surface 72B of the first guide pipe 72. However, it is also possible to adopt a structure in which such a gap (G) is not set. As another modified example, for example, it is possible to adopt a configuration in which the convex portions (80B) are not formed on the second guide pipe (80), and the gap (G) for shot media passage is set over the entire circumference of the second guide pipe (80) between the portion disposed inside the first guide pipe (72) and the inner surface (72B) of the first guide pipe (72).

In the above embodiment, as shown in FIG. 2, although three blasting areas A1, A2, A3 are set along the conveying direction of the wire rod W, it is possible to set one or two blasting areas, or even four or more blasting areas, along the conveying direction of the wire rod W.

In the above embodiment, the number of the blasting chamber 14 is one, but it is possible to set a plurality of blasting chambers along the conveying direction of the wire rod W.

Moreover; the above embodiment includes the connection plates 86, 88 shown in FIG. 2, etc., but it is possible to adopt a configuration including no such connection plates and to support the first guide pipes and the second guide pipes on the cabinet side by individually fixing the first guide pipes and the second guide pipes to the wall portion of the cabinet directly, or through a member, using bolts or pins. The first guide pipes and the second guide pipes may be connected to each other, for example, with connection rods as the connection member instead of the connection plates 86, 88 shown in FIG. 2, etc.

In the above embodiment, as shown in FIG. 5, the outer shape of the flange portion 80F of the second guide pipe 80 is a regular hexagon, but the outer shape of the flange portion of the second guide pipe may be polygon other than a regular hexagon, or circular. The same applies to the flange portions of the first guide pipes 70, 72 shown in FIG. 2 (see the first flange portion 72F and the second flange portion 72G of the first guide pipe 72 shown in FIG. 4, etc.).

Although the above embodiment includes the first seal structure portion 40 shown in FIG. 8 and the second seal structure portion 60 shown in FIG. 10, it is also possible to adopt a configuration in which one or both of the first seal structure portion 40 and the second seal structure portion 60 is/are replaced by, for example, a known seal structure portion disclosed in Japanese Unexamined Patent Publication No. 2012-35390, etc.

As a modified example of the above second embodiment, it is also possible to adopt a configuration in which the first guide pipe is supported on the cabinet side through a vibration absorbing member. Moreover, it is also possible to adopt a configuration in which the second guide pipe is supported on the cabinet side through the vibration absorbing member and the first guide pipe.

In the above embodiment, although three blasting devices are set, the number of blasting devices may be, for example, two, or four to eight, depending on the diameter of the wire rod, the processing speed and the required finish quality. In this case, the blasting devices are disposed so that the shot media are blasted toward the center line of the conveyance path of the wire rod and the angles formed by the center lines of the adjacent blasting directions are all equal as seen in the wire rod conveying direction. Further, in this case, when two or four blasting devices are installed, the blasting devices include blasting devices mounted to blast the shot media horizontally or vertically as an example, and when three or six blasting devices are installed, the blasting devices include blasting devices mounted to blast the shot media horizontally as an example.

In the above embodiment, the shot processing device is the shot blasting device 10 shown in FIG. 1, etc., but the shot processing device may be a shot peening device.

Note that the above embodiments and the plurality of above-described modified examples can be appropriately combined and implemented.

An example of the present disclosure has been described above, but the present disclosure is not limited to the above description and can, of course, be implemented in various modified forms without departing from the scope of the gist.

REFERENCE SIGNS LIST

10: shot blasting device (shot processing device), 12: cabinet, 16: first vertical wall portion, 18: second vertical wall portion, 20: inlet opening, 22: outlet opening, 24: first blasting device (blasting device), 26: second blasting device (blasting device), 28: third blasting device (blasting device), 40: first seal structure portion (seal structure portion), 42S: front apron chamber (adjacent chamber), 52: brush body, 52A: brush tip, 60: second seal structure portion (seal structure portion), 62S: shot blow down chamber (adjacent chamber), 70: upstream-side first guide pipe (first guide pipe), 70A: first insertion hole, 72: insert-receiving first guide pipe (first guide pipe), 72A: first insertion hole, 72P: positioning shaft portion, 74: downstream-side first guide pipe (first guide pipe), 74A: first insertion hole, 72J: axial center of first insertion hole of insert-receiving first guide pipe, 80: second guide pipe, 80A: second insertion hole, 80B: convex portion, 80C: center, 80Z: corner portion, 80F: flange portion, 80J: axial center of second insertion hole of second guide pipe, 80X: positioning hole, 86: connection plate (connection member), 88: connection plate (connection member), 90: mounting rod, 92: fixed plate member, 94: vibration absorbing member, A1: blasting area, A2: blasting area, A3: blasting area, G: gap, and W: wire rod.

The invention claimed is:

1. A shot processing device comprising:

a blasting device configured to blast shot media onto a wire rod which is an object to be processed and conveyed in a predetermined conveying direction;

a cabinet including a blasting area in which the wire rod is surface-processed by the shot media blasted by the blasting device, the blasting area being provided inside of the cabinet;

first guide pipes disposed on both sides of the blasting area, respectively, each of the first guide pipes having a first insertion hole formed to penetrate in the conveying direction of the wire rod and through which the wire rod is inserted, the first insertion hole having a diameter gradually reduced toward a downstream side in the conveying direction; and a second guide pipe disposed on at least one of both sides of the blasting area and having a second insertion hole formed to penetrate in the conveying direction of the wire rod and through which the wire rod is inserted, the second insertion hole having a diameter gradually reduced toward the downstream side in the conveying direction, the second guide pipe being installed in a state in which a downstream-side end portion in the conveying direction is inserted into the first insertion hole from an inlet side of the first guide pipe, wherein a gap for shot media passage is set at least in a part between a portion of the second guide pipe disposed inside the first guide pipe and an inner surface of the first guide pipe.

2. The shot processing device according to claim 1, wherein three or more of the blasting areas are provided and set along the wire rod conveying direction, and the second guide pipe is disposed at least between the blasting areas adjacent to each other.

3. The shot processing device according to claim 1, wherein the second guide pipe includes a plurality of convex portions formed on an outer peripheral surface side of the portion disposed inside the first guide pipe, protruding toward an inner surface side of the first guide pipe and coming into contact with the inner surface, and a flange portion formed at an upstream-side end portion in the conveying direction and protruding radially outward, the flange portion being formed with a plurality of positioning holes, and among the first guide pipes, an insert-receiving first guide pipe installed in a state in which the second guide pipe is inserted into the insert-receiving first guide pipe includes a positioning shaft portion protruding toward the upstream side in the conveying direction at an upstream-side end portion in the conveying direction and positioning an axial center of the first insertion hole of the insert-receiving first guide pipe and an axial center of the second insertion hole of the second guide pipe on a same straight line in a state in which the positioning shaft portion is inserted into the positioning hole.

4. The shot processing device according to claim 1, wherein a downstream-side end portion of the first guide pipe in the conveying direction and an upstream-side end portion of the second guide pipe or the other first guide pipe in the conveying direction disposed to face the downstream-side end portion of the first guide pipe in the conveying direction with the blasting area therebetween are connected with a connection member.

5. The shot processing device according to claim 3, wherein the downstream-side end portion of the first guide pipe in the conveying direction and an upstream-side end portion of the second guide pipe or the other first guide pipe in the conveying direction disposed to face the downstream-side end portion of the first guide pipe in the conveying direction with the blasting area therebetween are connected with a connection member.

6. The shot processing device according to claim 5, wherein an upstream-side first guide pipe disposed on a most upstream side in the conveying direction of the wire rod among the first guide pipes is fixed to a first vertical wall portion on the cabinet side, and the shot processing device includes:

a pair of mounting rods on which the first guide pipe and the second guide pipe are mounted, the mounting rods extending in the conveying direction of the wire rod and being supported on the cabinet side and disposed parallel to each other with a space between the mounting rods; and a fixed plate member fixed to a second vertical wall portion on the cabinet side in a state in which a downstream-side first guide pipe disposed on a most downstream side in the conveying direction of the wire rod among the first guide pipes is fitted into the fixed plate member.

7. The shot processing device according to claim 3, wherein an outer shape of the flange portion of the second guide pipe is a regular hexagon, and the positioning holes are formed on a same imaginary circle with a center of the regular hexagon as a center point and on straight lines connecting the center and corner portions on an outer peripheral side of the regular hexagon.

8. The shot processing device according to claim 1, wherein either of the first guide pipe and the second guide pipe is supported on the cabinet side through a vibration absorbing member.

9. The shot processing device according to claim 1, wherein the cabinet is formed with an inlet opening for carrying in the wire rod and an outlet opening for letting out the wire rod, at least either of an inlet opening side of the cabinet and an outlet opening side of the cabinet is provided with a seal structure portion having an adjacent chamber communicating with an internal space of the cabinet, and the seal structure portion includes a brush body having a brush tip arranged on a center side of a conveyance path of the wire rod as seen in the conveying direction of the wire rod, the brush body being helical about an axis in the conveying direction of the wire rod and elastically deformable.

10. The shot processing device according to claim 2, wherein the second guide pipe includes a plurality of convex portions formed on an outer peripheral surface side of the portion disposed inside the first guide pipe, protruding toward an inner surface side of the first guide pipe and coming into contact with the inner surface, and a flange portion formed at an upstream-side end portion in the conveying direction and protruding radially outward, the flange portion being formed with a plurality of positioning holes, and among the first guide pipes, an insert-receiving first guide pipe installed in a state in which the second guide pipe is inserted into the insert-receiving first guide pipe includes a positioning shaft portion protruding toward the upstream side in the conveying direction at an upstream-side end portion in the conveying direction and positioning an axial center of the first insertion hole of the insert-receiving first guide pipe and an axial center of the second insertion hole of the second guide pipe on a same straight line in a state in which the positioning shaft portion is inserted into the positioning hole.

11. The shot processing device according to claim 2, wherein a downstream-side end portion of the first guide pipe in the conveying direction and an upstream-side end portion of the second guide pipe or the other first guide pipe in the conveying direction disposed to face the downstream-side end portion of the first guide pipe in the conveying direction with the blasting area therebetween are connected with a connection member.

12. The shot processing device according to claim 5, wherein an outer shape of the flange portion of the second guide pipe is a regular hexagon, and the positioning holes are formed on a same imaginary circle with a center of the regular hexagon as a center point and on straight lines connecting the center and corner portions on an outer peripheral side of the regular hexagon.

13. The shot processing device according to claim 6, wherein an outer shape of the flange portion of the second guide pipe is a regular hexagon, and the positioning holes are formed on a same imaginary circle with a center of the regular hexagon as a center point and on straight lines connecting the center and corner portions on an outer peripheral side of the regular hexagon.

14. The shot processing device according to claim 2, wherein either of the first guide pipe and the second guide pipe is supported on the cabinet side through a vibration absorbing member.

15. The shot processing device according to claim 3, wherein either of the first guide pipe and the second guide pipe is supported on the cabinet side through a vibration absorbing member.

* * * * *